US007500462B2

(12) United States Patent
Karnes

(10) Patent No.: US 7,500,462 B2
(45) Date of Patent: Mar. 10, 2009

(54) INTERNAL COMBUSTION ENGINE

(75) Inventor: Mark D. Karnes, Columbia, KY (US)

(73) Assignee: Karnes Dyno-Rev Engine, Inc., Columbia, KY (US)

( * ) Notice: Subject to any disclaimer, the term of this patent is extended or adjusted under 35 U.S.C. 154(b) by 202 days.

(21) Appl. No.: 11/675,172

(22) Filed: Feb. 15, 2007

(65) Prior Publication Data

US 2007/0204831 A1 Sep. 6, 2007

Related U.S. Application Data

(60) Provisional application No. 60/779,338, filed on Mar. 3, 2006.

(51) Int. Cl.

| | |
|---|---|
| ***F02B 53/00*** | (2006.01) |
| ***F02B 57/00*** | (2006.01) |
| ***F02B 57/08*** | (2006.01) |
| ***F02B 75/26*** | (2006.01) |

(52) U.S. Cl. ..... 123/241; 123/43 C; 123/43 R

(58) Field of Classification Search ..... 123/43 C, 123/241, 245, 43 R, 44 D See application file for complete search history.

(56) References Cited

U.S. PATENT DOCUMENTS

| | | | | |
|---|---|---|---|---|
| 925,203 | A | 6/1909 | Leiman et al. | |
| 1,236,009 | A | 8/1917 | Saunders | 123/43 R |
| 1,400,255 | A | 12/1921 | Anderson | 123/43 C |
| 2,938,505 | A | 5/1960 | Quartier | 123/225 |
| 3,435,808 | A | 4/1969 | Allender | |
| 3,923,013 | A | 12/1975 | Myers | 123/43 C |
| 4,057,374 | A | 11/1977 | Seybold | 123/245 |
| 4,214,557 | A | 7/1980 | Beach, Jr. | |
| 4,290,341 | A | 9/1981 | Scheibengraber | |

(Continued)

FOREIGN PATENT DOCUMENTS

JP 02168872 A * 6/1990

OTHER PUBLICATIONS

ISA/US; International Search Report and Written Opinion for International Application No. PCT/US07/92273, Feb. 21, 2008.

(Continued)

*Primary Examiner*—Thai-Ba Trieu
(74) *Attorney, Agent, or Firm*—Stites & Harbison, PLLC; David W. Nagle, Jr.; Robert C. Yang

(57) ABSTRACT

An internal combustion engine operates on a four-stroke cycle and includes a housing defining: one or more generally wedge-shaped combustion chambers, and an internal cavity in which a wheel is mounted for rotation on a crankshaft. Arranged inside each combustion chamber is a gate, with each gate having a corresponding gate control assembly including a control shaft. Each control shaft is supported by bearings that engage and ride in a generally elliptical cam-cutout defined in the surface of the wheel. Movement of the gate control assemblies within and with respect to the elliptical cam-cutout controls the movement and operation of the gates, such that, as the wheel rotates, a fuel/air mixture is drawn into a combustion chamber; compressed by the rotating movement of a gate; and ignited, imparting a force on the gate, with the gate then rotating to expel combustion gases through an exhaust port.

17 Claims, 8 Drawing Sheets

U.S. PATENT DOCUMENTS

| | | | | |
|---|---|---|---|---|
| 4,562,802 | A | 1/1986 | Groeger | 123/241 |
| 4,823,743 | A | 4/1989 | Ansdale | |
| 5,261,365 | A | 11/1993 | Edwards | 123/241 |
| 5,345,905 | A | 9/1994 | Edwards | 123/241 |
| 5,415,141 | A | 5/1995 | McCann | |
| 5,704,332 | A | 1/1998 | Motakef | |
| 5,727,517 | A | 3/1998 | Mallen | |
| 5,803,041 | A | 9/1998 | Motakef | |
| 6,688,276 | B2 | 2/2004 | Baptista et al. | 123/43 C |
| 6,796,285 | B2 | 9/2004 | Karnes | 123/241 |

OTHER PUBLICATIONS

IPEA/US, International Preliminary Report on Patentability for International Application No. PCT/US07/62273, mailed Nov. 7, 2008.

* cited by examiner

INTERNAL COMBUSTION ENGINE

CROSS-REFERENCE TO RELATED APPLICATIONS

This application claims priority to U.S. Provisional Patent Application No. 60/779,338, filed Mar. 3, 2006, the entire disclosure of which is incorporated herein by reference.

BACKGROUND OF THE INVENTION

The present invention relates to internal combustion engines. In an internal combustion engine, the basic functionality includes: (1) the intake of a fuel-air mixture into a combustion chamber; (2) the compression of the fuel-air mixture; (3) the ignition of the fuel-air mixture; and (4) the expansion of the ignited mixture and exhausting of the combustion gases. The resultant release of energy in the form of expanding gas is used to power various mechanical devices, including vehicles.

A reciprocating internal combustion engine is perhaps the most common form of internal combustion engine. In a reciprocating internal combustion engine, the reciprocating motion of a piston in a cylinder results in the compression of the fuel-air mixture and the expansion of combustion gases. The energy is transformed from linear motion into rotational motion through connection of the piston to a crankshaft.

Most modern vehicle engines currently use a piston-cylinder arrangement in what is referred to as a four-stroke combustion cycle, comprised of (1) an intake stroke, (2) a compression stroke, (3) a combustion stroke, and (4) an exhaust stroke. In a four-stroke combustion cycle using a typical piston-cylinder arrangement, the piston starts at the top of the combustion chamber (i.e., the cylinder), and an intake valve opens. The piston moves downwardly within the cylinder, and the fuel-air mixture is drawn into the cylinder through the intake valve, completing the intake stroke. The piston then moves back upwardly to compress the fuel-air mixture until reaching the top of the stroke, completing the compression stroke. When the piston reaches the top of the stroke, the spark plug ignites the compressed fuel-air mixture, resulting in a controlled explosion that drives the piston downwardly, completing the combustion stroke. Finally, once the piston reaches the bottom of its stroke, an exhaust valve opens, and combustion gases are forced out of the cylinder by the upward movement of the piston back to the top of its stroke, completing the exhaust stroke and readying the piston for a subsequent combustion cycle.

Although common in vehicles, a reciprocating internal combustion engine using a four-stroke combustion cycle does have some disadvantages. As a result, other engines have been developed that use the same basic combustion principles with some variation. For example, in an internal combustion engine using a two-stroke combustion cycle, the intake and exhaust valves are eliminated. Instead, intake and exhaust ports are located on opposite sides of the cylinder. After each expansion stroke, combustion gases under pressure exit the cylinder through the exhaust port, and a fuel-air mixture is drawn in through the intake port. Although there is only one expansion cycle per crankshaft revolution, a two-cycle engine is must less efficient than a four-cycle engine.

Another reciprocating internal combustion engine is a diesel engine, which can have a four-stroke or a two-stroke combustion cycle. Unlike the above-described engines, however, a diesel engine draws in and compresses only air in the cylinder. This air is compressed by the piston to more than 450 psi, resulting in an air temperature of about 900-1100° F.

At the bottom of the compression stroke, diesel fuel is injected into the cylinder, and the temperature of the air within the cylinder is sufficient to cause ignition of the fuel-air mixture without the need for a spark plug.

In any event, a reciprocating internal combustion engine has its disadvantages. The piston has a significant mass and thus inertia, which can cause vibration during motion and limits the maximum rotational speed of the crank shaft. Furthermore, such engines have relatively low mechanical and fuel efficiencies.

As a result of such disadvantages, some attempts have been made to propose alternate combustion engine designs. Perhaps the most well-known and commercially successful of these alternate designs is the Wankel or rotary piston engine. The Wankel engine has a quasi-triangular rotating piston that moves along an eccentric path to rotate the crankshaft. Rather than using inlet and exhaust valves, the edges of the rotating piston open and close ports in the wall of the combustion chamber. In other words, intake and exhaust timing are controlled solely by the motion of the rotor.

As the piston of the Wankel engine rotates, seals mounted at its three corners continuously sweep along the wall of the combustion chamber. The enclosed volumes formed between the piston and the wall increase and decrease through each revolution of the piston. A fuel-air mixture is drawn into an enclosed volume, compressed by the rotation of the piston that decreases the enclosed volume, and then ignited with the combustion gases being accommodated by and expelled through the expansion of the enclosed volume. In short, a complete four-stroke combustion cycle is achieved, but since there is no reciprocating motion, higher rotational speeds are possible.

The most pronounced disadvantage of a Wankel or rotary piston engine is the difficulty in adequately sealing the enclosed spaces between the piston and the wall of the combustion chamber that increase and decrease through each revolution of the piston. If these enclosed spaces are allowed to communicate with another, the engine cannot properly function.

Since development of the Wankel engine, some attempts have been made to address such shortcomings of a Wankel or rotary piston engine. For example, U.S. Pat. No. 5,415,141 describes and claims an engine that has a central rotor and a plurality of radially sliding vanes. The vanes rotate clockwise with the rotor to form enclosed volumes between the vanes, the side walls of the combustion chamber, and the rotor. These enclosed volumes decrease and increase in volume throughout the combustion cycle, with the fuel-air mixture being drawn into an enclosed volume, compressed by the rotation of the rotor and associated vane, and then ignited with the combustion gases being accommodated by and expelled through the expansion of the enclosed volume. Nevertheless, as with a Wankel engine, such a design still suffers from the problem of adequate sealing of the enclosed volumes from one another. Furthermore, the drag of the vanes along the wall of the combustion chamber reduces power and fuel efficiency.

As another alternative, U.S. Pat. No. 6,796,285 describes and claims an internal combustion engine that has a torque wheel mounted for rotation within the central cavity defined by a housing and driving a crankshaft. The torque wheel includes a plurality of separate arms in a spaced arrangement about the center of the torque wheel, thereby defining corresponding volumes between the respective arms. Positioned within these volumes are substantially identical combustion gates. As the torque wheel rotates, the combustion gates are moved through an elliptical path. Air is drawn into the central cavity of the housing, and fuel is introduced into the central cavity of the housing to create a fuel/air mixture in one of the volumes between the respective arms of said torque wheel and adjacent one of the combustion gates. This fuel/air mixture is then compressed during the continuing rotation of the torque wheel by the pivoting and outward movement of the combustion gate. The fuel/air mixture is then ignited, causing a rapid expansion of combustion gases and imparting a torque that causes continued rotation of the torque wheel. The combustion gate then pivots and moves inwardly toward the center of the torque wheel, allowing the combustion gases to expand, and then pivots and move outwardly again, forcing the combustion gases through an exhaust outlet.

Nevertheless, there remains a need for a durable, fuel-efficient internal combustion engine that can rotate faster than common gas-powered engines, while maintaining a constant rotational speed with a high power output to weight ratio.

SUMMARY OF THE INVENTION

An internal combustion engine made in accordance with the present invention includes a front housing (or engine block) that defines one or more generally wedge-shaped combustion chambers. The internal combustion engine further includes a second, rear housing that defines an internal cavity in which a wheel is mounted for rotation. This wheel is mounted on a crankshaft that extends through both the front and rear housings of the engine and is supported by a series of bearings.

Arranged inside each combustion chamber is a gate. These gates are also generally wedge-shaped, but become narrower as the respective combustion chamber widens. In other words, the widest portion of each gate is positioned within and essentially fills the narrowest portion of the respective combustion chamber. It is contemplated and preferred that a series of seals is arranged around the perimeter of each gate such that they substantially form a seal between the gate and the respective combustion chamber.

Each gate in the engine includes a corresponding gate control assembly. Each gate control assembly includes a control shaft which is connected to a respective gate and defines a pivot point for rotation of the gate. Each control shaft extends rearward and is supported by a series of bearings. At the distal end of each control shaft, there is an L-shaped control arm having a first end and second end. The first end is integral with or attached to the control shaft, while the second end extends into the rear housing.

The front face of the wheel, which is mounted for rotation within an internal cavity defined by the rear housing, defines a generally elliptical cam-cutout in its surface. Mounted to the second ends of the respective L-shaped control arms are one or more roller bearings which engage and ride in the elliptical cam-cutout. In this regard, it is contemplated that the elliptical cam-cutout has a stair-step cross-section for receiving a pair of roller bearings. By constructing the elliptical cam-cutout with such a stair-step cross-section, one roller bearing abuts a lower side wall of the elliptical cam-cutout while another roller bearing abuts an upper side wall of the elliptical cutout. The movement of the gate control assemblies within and with respect to the elliptical cam-cutout controls the movement and operation of the gates within the respective combustion chambers.

In the internal combustion engine, two cylinder heads are attached to opposite sides of the housing. Each head defines two ports for each combustion chamber: an intake port for drawing a fuel-air mixture into the combustion chamber, and an exhaust port for exhausting combustion gases. Furthermore, each cylinder head also includes a sparkplug, which is preferably controlled by an electronic spark control system.

The internal combustion engine operates on a four-stroke cycle. First, as an electronic starter turns the crankshaft and wheel, the elliptical cam-cutout causes the control arms to start moving. As a particular gate rotates to maximize the volume of the combustion chamber, the intake valve is opening. Thus, a fuel/air mixture is drawn into the combustion chamber between the gate and the wall of the housing. Then, as the wheel continues to turn, the elliptical cam-cutout acts on the control assembly to rotate the gate outwardly, compressing the air/fuel mixture within the combustion chamber between the gate and the wall of the housing. The fuel/air mixture is then ignited by a sparkplug. The ignition of the compressed fuel/air mixture causes a rapid expansion of combustion gases, imparting a force on the gate, and thus the wheel, as the wheel continues to rotate. Finally, the gate then begins to again rotate inwardly, minimizing the volume between the gate and the wall of the housing. An exhaust valve then opens, such that this rotation of the gate forces the combustion gases through the exhaust port.

DESCRIPTION OF THE INVENTION

Figure 1:
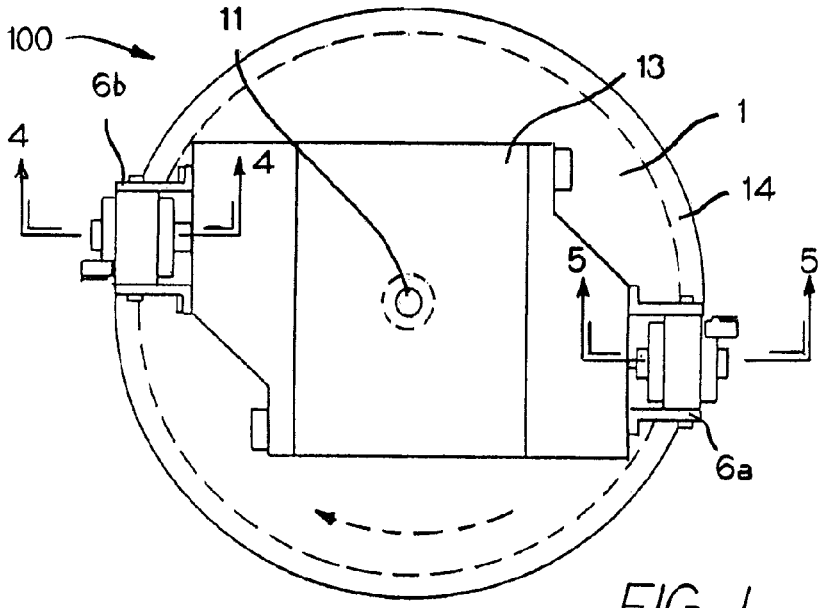
FIG. 1 is a front view of an exemplary internal combustion engine made in accordance with the present invention.
Figure 2:
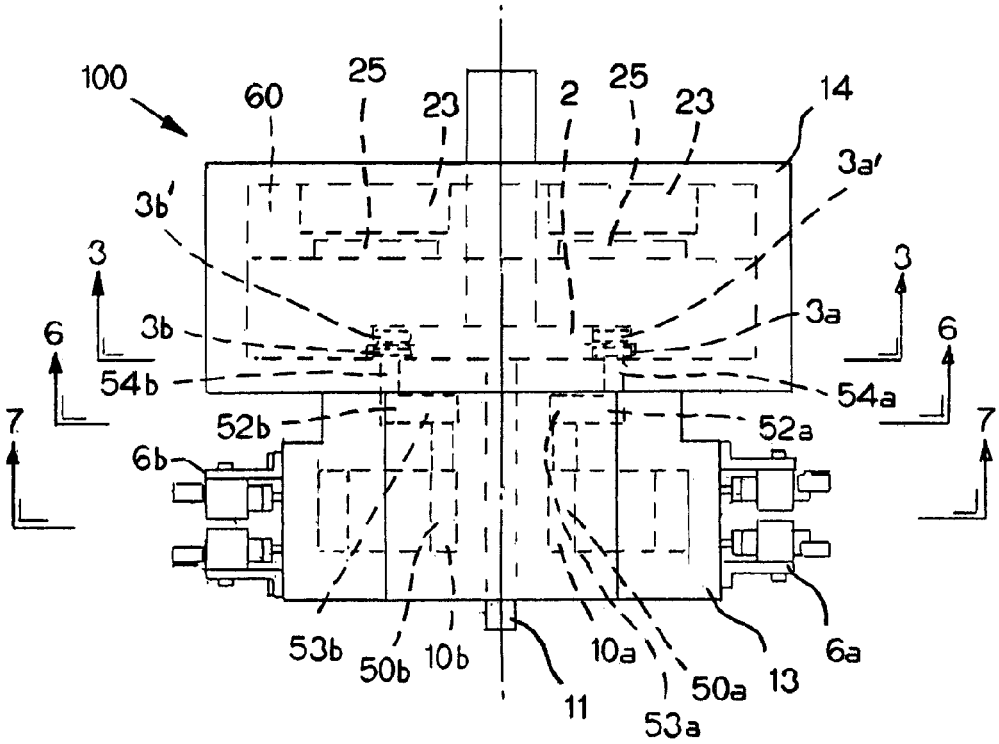
FIG. 2 is a top view of the exemplary internal combustion engine of FIG. 1.
Figure 7:
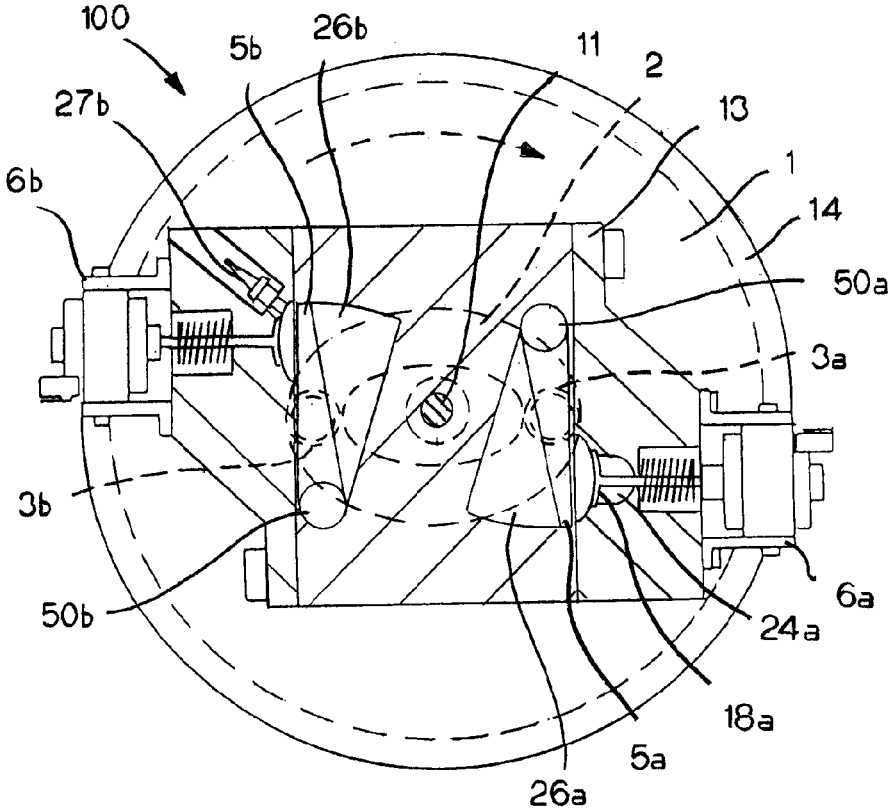
FIG. 7 is a sectional view of the exemplary internal combustion engine of FIGS. 1-2, taken along line 7-7 of FIG. 2.
Figure 8:
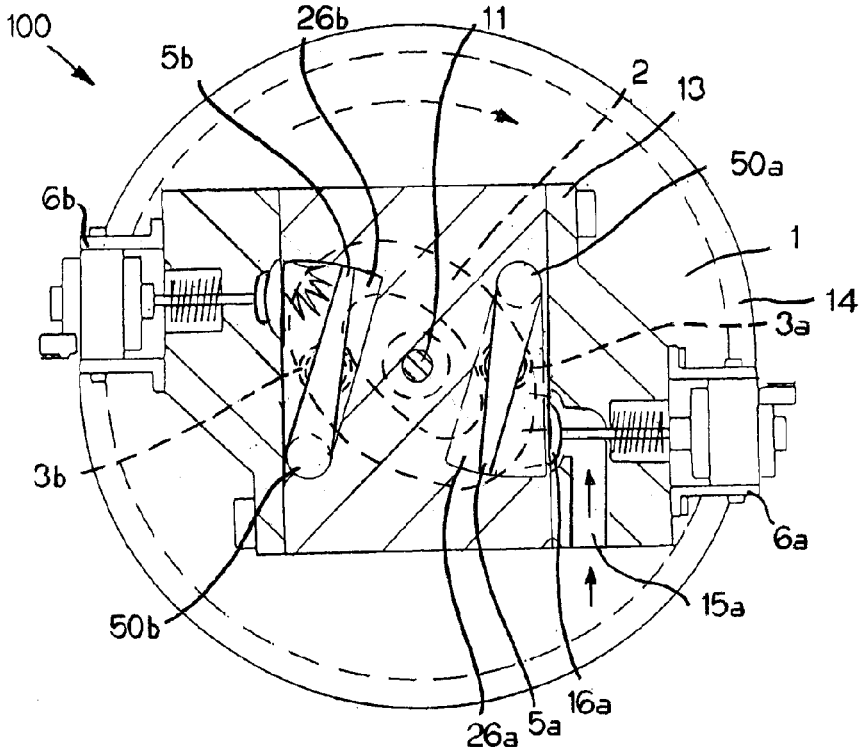
FIG. 8 is a sectional view similar to FIG. 7, and further illustrating, on the right side, the fuel/air mixture being drawn from the intake port as part of the four-stroke combustion cycle.

Referring first to FIGS. 1, 2, and 7, an exemplary internal combustion engine 100 made in accordance with the present invention includes a front housing (or engine block) 13 that defines two generally wedge-shaped combustion chambers 26*a*, 26*b*, although there could be fewer or more chambers without departing from the spirit and scope of the present invention. The exemplary internal combustion engine 100 further includes a second, rear housing 14 that defines an internal cavity 60 in which a wheel 1 is mounted for rotation. This wheel 1 is mounted on a crankshaft 11 that extends through both the front and rear housings 13, 14 of the engine 100 and is supported by a series of bearings (not shown).

Returning to the front housing 13, arranged inside each combustion chamber 26*a*, 26*b* is a gate 5*a*, 5*b*. As illustrated in FIG. 7, these gates 5*a*, 5*b* are also generally wedge-shaped, but become narrower as the respective combustion chamber 26*a*, 26*b* widens. In other words, the widest portion of each gate 5*a*, 5*b* is positioned within and essentially fills the narrowest portion of the respective combustion chamber 26*a*, 26*b*. Also, although not clearly illustrated in the Figures, it is contemplated and preferred that a series of seals is arranged around the perimeter of each gate 5*a*, 5*b* such that they substantially form a seal between the gate 5*a*, 5*b* and the respective combustion chamber 26*a*, 26*b*. In other words, gasses cannot pass around a gate 5*a*, 5*b* from one side of the combustion chamber 26*a*, 26*b* to the other.

Referring still to FIGS. 1, 2, and 7, each gate 5*a*, 5*b* in the exemplary engine 100 includes a corresponding gate control assembly 10*a*, 10*b*. Each gate control assembly 10*a*, 10*b* includes a control shaft 50*a*, 50*b* which is connected to a respective gate 5*a*, 5*b* and defines a pivot point for rotation of the gate 5*a*, 5*b*. Since each control shaft 50*a*, 50*b* is connected to the end of the respective gate 5*a*, 5*b*, the rotation of each gate 5*a*, 5*b* is best described as a pivoting side-to-side motion similar to that of a common windshield wiper. In any event, each control shaft 50*a*, 50*b* extends rearward and is supported by a series of bearings (not shown). At the distal end of each control shaft 50*a*, 50*b*, there is an L-shaped control arm 52*a*, 52*b* having a first end 53*a*, 53*b* and second end 54*a*, 54*b*. The first end 53*a*, 53*b* is integral with or attached to the control shaft 50*a*, 50*b*, while the second end 54*a*, 54*b* extends into the rear housing 14.

Figure 3:
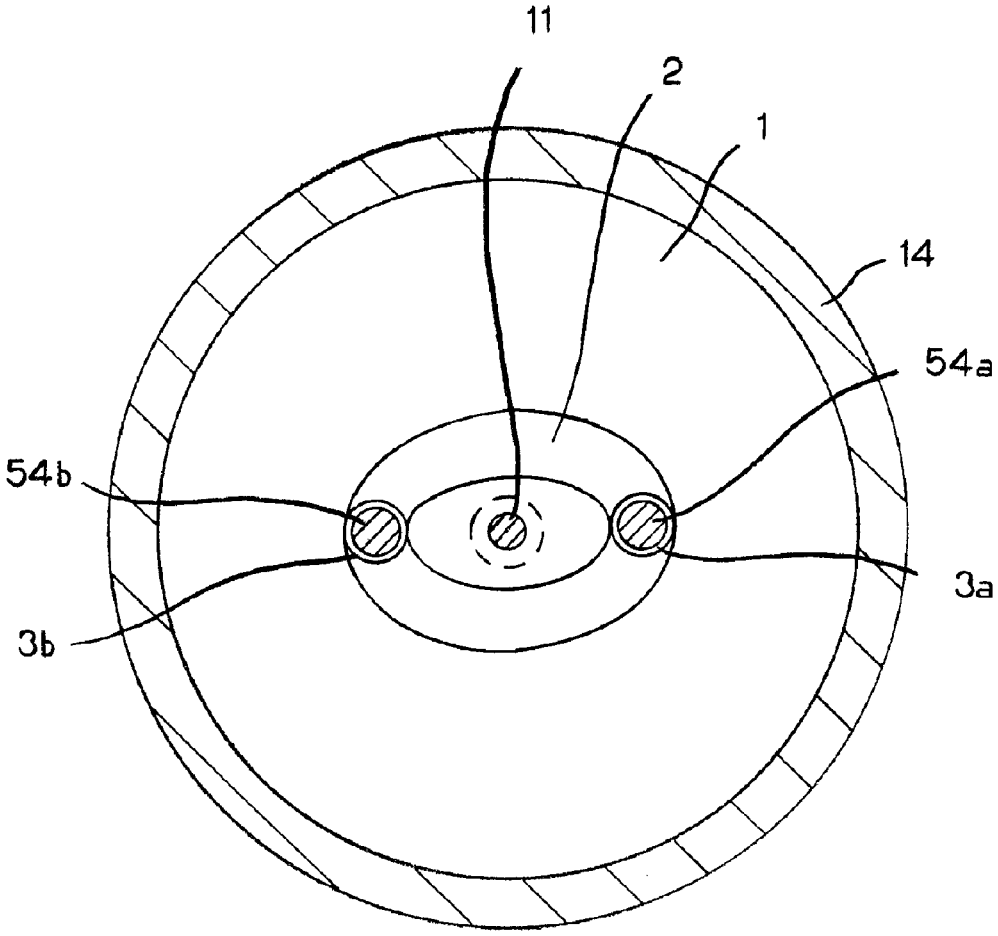
FIG. 3 is a sectional view of the exemplary internal combustion engine of FIGS. 1-2, taken along line 3-3 of FIG. 2.
Figure 4:
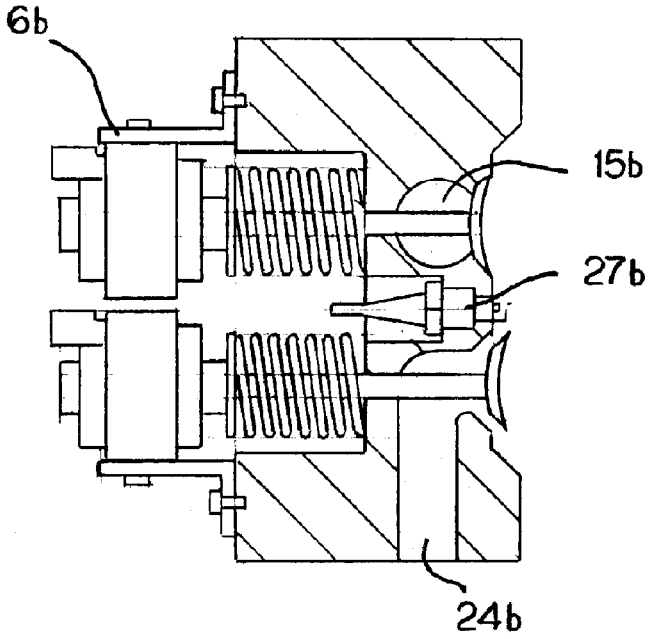
FIG. 4 is a sectional view of the exemplary internal combustion engine of FIGS. 1-2, taken along line 4-4 of FIG. 1.
Figure 5:
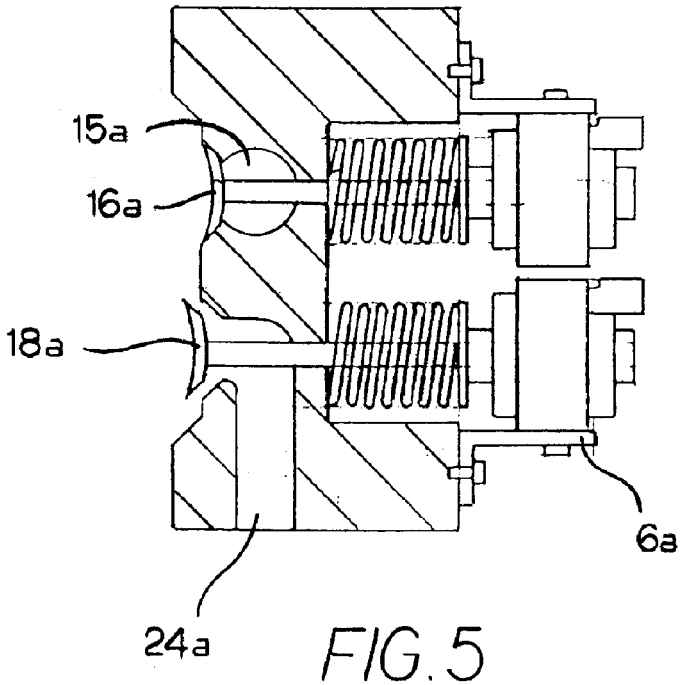
FIG. 5 is a sectional view of the exemplary internal combustion engine of FIGS. 1-2, taken along line 5-5 of FIG. 1.
Figure 6:
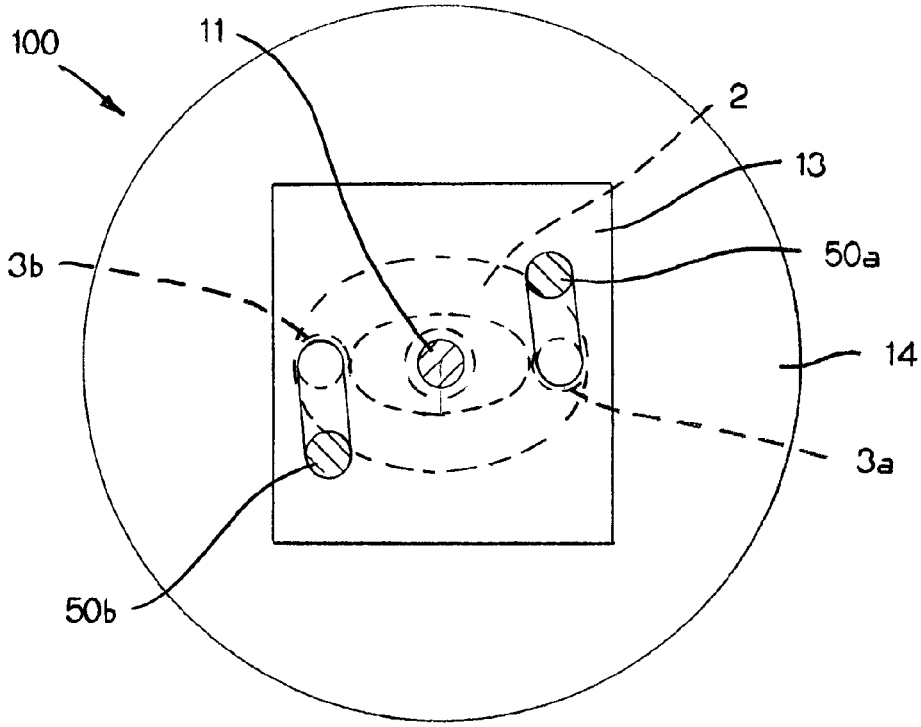
FIG. 6 is a sectional view of the exemplary internal combustion engine of FIGS. 1-2, taken along line 6-6 of FIG. 2.

Referring now to FIG. 3, the front face of the wheel 1, which is mounted for rotation within an internal cavity 60 defined by the rear housing 14, defines a generally elliptical cam-cutout 2 in its surface. Mounted to the second ends 54*a*, 54*b* of the respective L-shaped control arms 52*a*, 52*b* are one or more (two in the example) roller bearings 3*a*, 3*b* which engage and ride in the elliptical cam-cutout 2. In this regard, and as best illustrated in FIG. 2, it is contemplated that the elliptical cam-cutout 2 has a stair-step cross-section for receiving each pair of roller bearings 3*a*, 3*a*', 3*b*, 3*b*'. As described in U.S. Pat. No. 6,796,285, which is incorporated herein by this reference, by constructing the elliptical cam-cutout 2 with such a stair-step cross-section, one roller bearing abuts a lower side wall of the elliptical cam-cutout 2 while another roller bearing abuts an upper side wall of the elliptical cam-cutout 2. Thus, the stair-step construction of the elliptical cam-cutout 2 and the relationship with the roller bearings 3*a*, 3*a*', 3*b*, 3*b*' prevent dramatic movements of the control arms 52*a*, 52*b*, which could impede optimal performance of the engine 100. In any event, and as will be described in further detail below, the movement of the gate control assemblies 10*a*, 10*b* within and with respect to the elliptical cam-cutout 2 controls the movement and operation of the gates 5*a*, 5*b* within the respective combustion chambers 26*a*, 26*b*.

Referring now to FIGS. 1, 4, 5, 7, and 11, in the exemplary engine 100, two cylinder heads 6*a*, 6*b* are attached to opposite sides of the front housing 13. Each head 6*a*, 6*b* defines two ports for each combustion chamber 26*a*, 26*b*: an intake port 15*a*, 15*b* for drawing a fuel-air mixture into the combustion chamber 26*a*, 26*b*, and an exhaust port 24*a*, 24*b* for exhausting combustion gases. In the exemplary engine 100, such intake 15*a*, 15*b* and exhaust 24*a*, 24*b* ports, including the valves associated with these ports, are typical of those commonly found in automobile engines. Furthermore, each cylinder head 6*a*, 6*b* also includes a sparkplug 27*a*, 27*b*, which are each preferably controlled by an electronic spark control system (not shown). Such sparkplugs and associated control systems are also typical of those commonly found in automobile engines.

Figure 9:
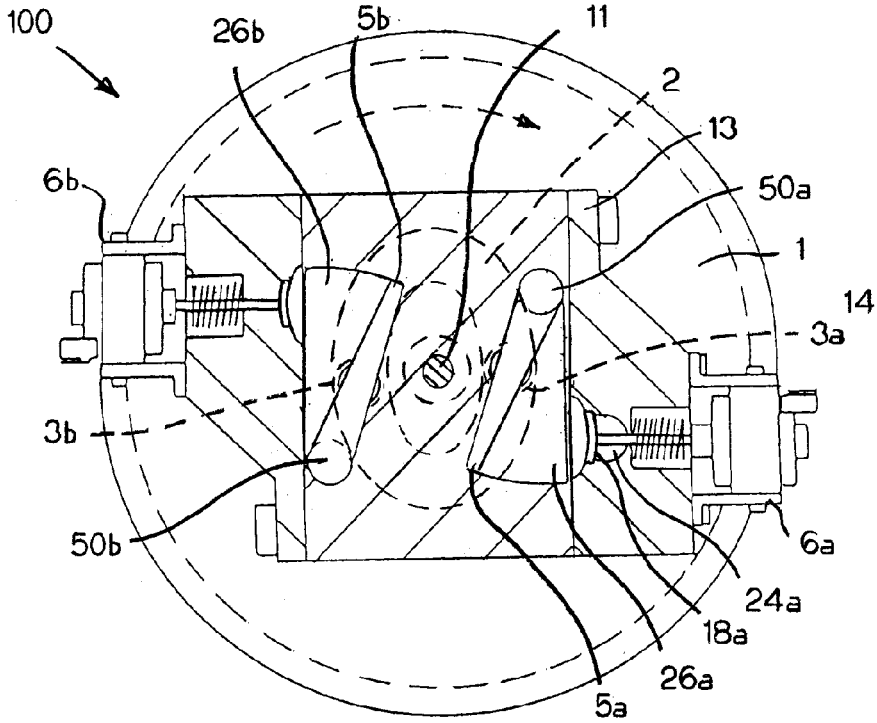
FIG. 9 is a sectional view similar to FIG. 7, and further illustrating, on the right side, the fuel/air mixture being received in the combustion chamber between the gate and the wall of the housing as part of the four-stroke combustion cycle.
Figure 10:
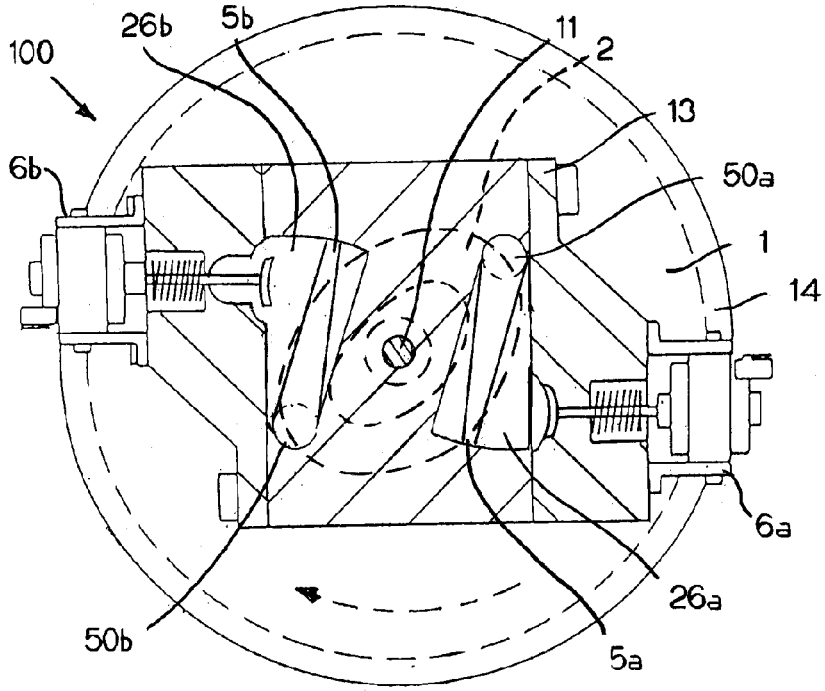
FIG. 10 is a sectional view similar to FIG. 7, and further illustrating, on the right side, the compression of the fuel/air mixture as part of the four-stroke combustion cycle.

Referring now to FIGS. 7-14, the exemplary internal combustion engine 100 operates on a four-stroke cycle. First, as shown in FIG. 7, as an electronic starter (not shown) turns the crankshaft 11 and wheel 1, the elliptical cam-cutout 2 causes the control arms 52*a*, 52*b* to start moving. Focusing on the right side of the exemplary engine 100 and the gate 5*a* in FIG. 8, as this gate 5*a* rotates to maximize the volume of the combustion chamber 26*a*, an intake valve 16*a* is opening. Thus, a fuel/air mixture is drawn from the intake port 15*a* into the combustion chamber 26*a* between the gate 5*a* and the wall of the front housing 13, as shown in FIG. 9. Then, as the wheel 1 continues to turn, the elliptical cam-cutout 2 acts on the control assembly 10*a* to rotate the gate 5*a* outwardly, compressing the air/fuel mixture within the combustion chamber 26*a* between the gate 5*a* and the wall of the front housing 13, as shown in FIG. 10.

Figure 11:
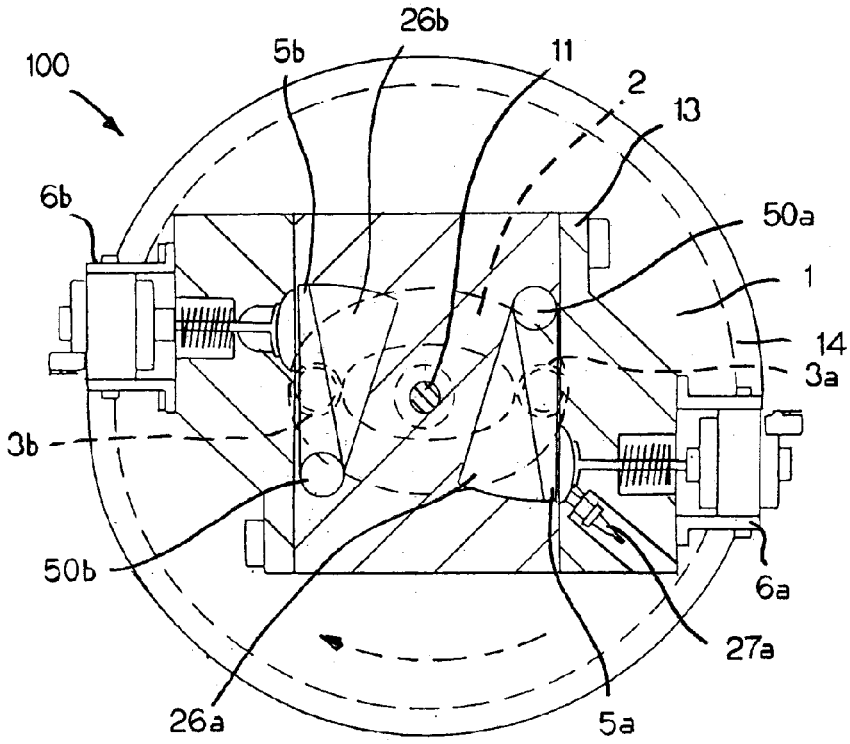
FIG. 11 is a sectional view similar to FIG. 7 and further illustrating, on the right side, the ignition of the fuel/air mixture by a sparkplug as part of the four-stroke combustion cycle.
Figure 12:
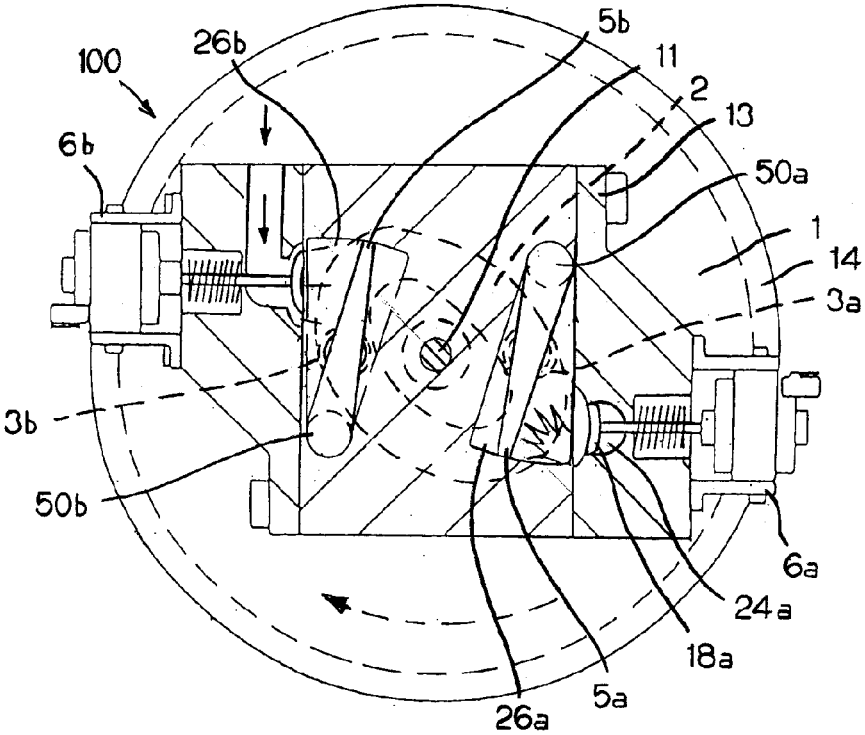
FIG. 12 is a sectional view similar to FIG. 7 and further illustrating, on the right side, the combustion of the fuel/air mixture as part of the four-stroke combustion cycle.
Figure 13:
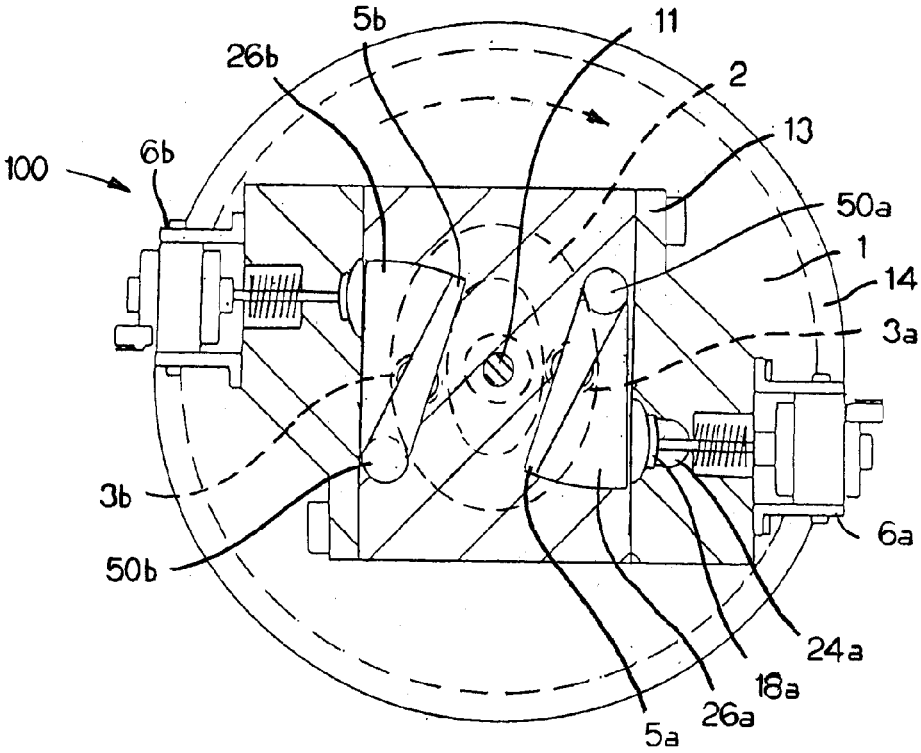
FIG. 13 is a sectional view similar to FIG. 7 and further illustrating, on the right side, the expansion of the combustion gases as part of the four-stroke combustion cycle.
Figure 14:
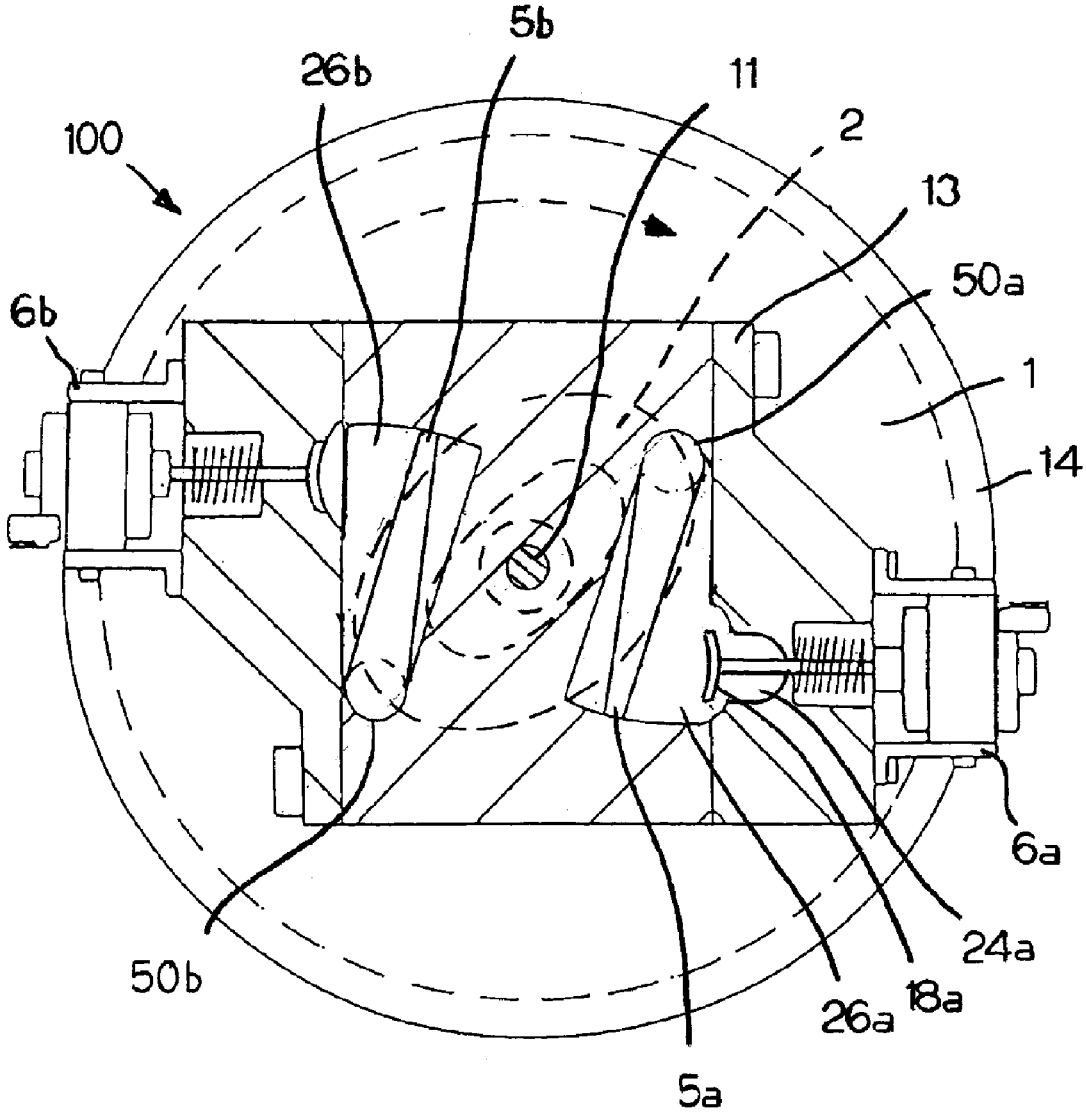
FIG. 14 is a sectional view similar to FIG. 7 and further illustrating, on the right side, the exhaust valve opening to force combustion gases through the exhaust port as part of the four-stroke combustion cycle.

Referring still to the right side of the exemplary engine 100 and the gate 5*a*, in FIG. 11, the fuel/air mixture is ignited by a sparkplug 27*a*. The ignition of the compressed fuel/air mixture causes a rapid expansion of the combustion gases, imparting a force on the gate 5*a*, and thus the wheel 1, as the wheel 1 continues to rotate as shown in FIGS. 12-14. Finally, the gate 5*a* then begins to again rotate inwardly, minimizing the volume between the gate 5*a* and the wall of the front housing 13. An exhaust valve 18*a* then opens, such that this rotation of the gate 5*a* forces the combustion gases through the exhaust port 24*a*, as shown in FIG. 14.

During the rotation of the wheel 1 illustrated in FIGS. 7-14, on the left side of the exemplary engine 100, the other gate 5*b* is simultaneously going through a four-stroke cycle. However, when the gate 5*a* is starting its combustion cycle and drawing in a fuel-air mixture, the other gate 5*b* is completing a cycle, allowing combustion gases to expand and exhaust.

The internal combustion engine 100 constructed in accordance with the above specification avoids the problems of common reciprocating motion, piston-type engines and those of rotary combustion engines. Unlike a reciprocating motion, piston-type engine, minimal fuel and air for each combustion cycle is needed since it is not necessary to force a piston a substantial vertical distance within a cylinder. Rather, since the wheel 1 has a substantial mass and inertia, a relatively small combustion is sufficient to drive the wheel 1.

Furthermore, when a piston-cylinder arrangement is used, an offset crankshaft is necessary for transforming the energy from linear motion into rotational motion, resulting in a loss of efficiency. Similarly, a rotary piston engine requires an offset crankshaft due to the eccentric movement of the rotary piston within the combustion chamber. The wheel 1 of the engine 100 of the present invention is directly secured to the crankshaft 11 so there is no transformation of energy. The crankshaft 11 rotates with the wheel 1. In this regard, it is preferred that the engine 100 of the present invention be run at a constant rotational speed (RPM) in conjunction with a transmission designed to control the output speed.

Also, as a further refinement, it should be noted that in the embodiment illustrated in FIG. 2, the side of the wheel 1 opposite the elliptical cam-cutout 2 may include a series of magnets 25. A wall of the rear housing 14 facing the series of magnets 25 includes a corresponding series of magnets 23. Accordingly, the magnets 25 on the wheel 1 and the magnets 23 on the rear housing 14 act as a permanent magnet generator to produce electricity, which can then be used to power auxiliary equipment associated with the engine 100.

As yet another refinement, during operation, the exemplary engine 100 may be cooled by either air or liquid by passing through channels (not shown) defined by the cylinder heads 6*a*, 6*b* and/or the front housing 13.

One of ordinary skill in the art will recognize that additional embodiments are also possible without departing from the teachings of the present invention. This detailed description, and particularly the specific details of the exemplary embodiment disclosed therein, is given primarily for clarity of understanding, and no unnecessary limitations are to be understood therefrom, for modifications will become obvious to those skilled in the art upon reading this disclosure and may be made without departing from the spirit or scope of the invention.

The invention claimed is:

1. An internal combustion engine, comprising:

a housing defining one or more combustion chambers and a cavity in which a wheel is mounted for rotation on a crankshaft;

one or more gates, each such gate mounted for rotation about a pivot point within one of said combustion chambers; and one or more gate control assemblies, each such gate control assembly operably connecting a respective gate to the wheel, such that as the wheel rotates, movement of the gate control assemblies controls the rotation of the gates within the respective combustion chambers;

wherein a face of said wheel defines a generally elliptical cam-cutout, and wherein each gate control assembly includes a control shaft which is connected to a respective gate and defines the pivot point for rotation of the gate, and a control arm having a first end that is integral with or attached to the control shaft and a second end that engages said elliptical cam-cutout;

wherein, as the wheel rotates, a fuel/air mixture is drawn into one of said combustion chambers, the fuel/air mixture then being compressed by the rotation of the gate within said combustion chamber, the fuel/air mixture then being ignited, causing a rapid expansion of combustion gases and imparting a force on the gate, and thus the wheel, with the gate then rotating to minimize the volume of the combustion chamber and forcing the combustion gases through an exhaust port.

2. The internal combustion engine as recited in claim 1, and further comprising one or more bearings at the second end of each control arm, said bearings engaging and riding in said elliptical cam-cutout.

3. The internal combustion engine as recited in claim 2, wherein two bearings are mounted to the second end of each control arm for engaging and riding in said elliptical cam-cutout.

4. The internal combustion engine as recited in claim 3, wherein said elliptical cam-cutout has a stair-step cross-section for receiving the two bearings, with one bearing abutting a lower side wall of the elliptical cam-cutout and the other bearing abutting an upper side wall of the elliptical cam-cutout.

5. The internal combustion engine as recited in claim 1, in which said internal combustion engine includes at least two combustion chambers, with one gate positioned within each said combustion chamber.

6. The internal combustion engine as recited in claim 1, in which each combustion chamber is generally wedge-shaped.

7. The internal combustion engine as recited in claim 6, in which each gate is generally wedge-shaped.

8. The internal combustion engine as recited in claim 7, in which the widest portion of each gate is positioned within and essentially fills the narrowest portion of the respective combustion chamber.

9. The internal combustion engine as recited claim 1, and further comprising a series of magnets located on a side of said wheel and a corresponding series of magnets located on a wall of the housing facing said series of magnets, wherein said magnets act as a permanent magnet generator to produce electricity to power auxiliary equipment associated with said engine.

10. An internal combustion engine, comprising:

a front housing defining one or more combustion chambers;

a rear housing defining an internal cavity in which a wheel is mounted for rotation on a crankshaft, a face of said wheel defining a generally elliptical cam-cutout;

one or more substantially identical gates, each positioned within one of said combustion chambers;

one or more gate control assemblies, each gate control assembly including a control shaft which is connected to a respective gate and defines a pivot point for rotation of the gate, and a control arm having a first end that is integral with or attached to the control shaft and a second end that extends into the rear housing; and one or more bearings at the second end of each control arm, said bearings engaging and riding in said elliptical cam-cutout such that as the wheel rotates, movement of the gate control assemblies within and with respect to said elliptical cam-cutout controls the movement and operation of the gates within the respective combustion chambers;

wherein, as the wheel rotates, a fuel/air mixture is drawn into one of said combustion chambers, the fuel/air mixture then being compressed by the rotating movement of one of said gates as the elliptical cam-cutout acts on the control assembly associated with that gate, the fuel/air mixture then being ignited, causing a rapid expansion of combustion gases and imparting a force on the gate, and thus the wheel, with the gate then beginning to again rotate inwardly, minimizing the volume of the combustion chamber and forcing the combustion gases through an exhaust port.

11. The internal combustion engine as recited in claim 10, in which said internal combustion engine includes at least two combustion chambers, with one gate positioned within each said combustion chamber.

12. The internal combustion engine as recited in claim 10, in which each combustion chamber is generally wedge-shaped.

13. The internal combustion engine as recited in claim 12, in which each gate is generally wedge-shaped.

14. The internal combustion engine as recited in claim 13, in which the widest portion of each gate is positioned within and essentially fills the narrowest portion of the respective combustion chamber.

15. The internal combustion engine as recited in claim 10, wherein two bearings are mounted to the second end of each control arm for engaging and riding in said elliptical cam-cutout.

16. The internal combustion engine as recited in claim 15, wherein said elliptical cam-cutout has a stair-step cross-section for receiving the two bearings, with one bearing abutting a lower side wall of the elliptical cam-cutout and the other bearing abutting an upper side wall of the elliptical cam-cutout.

17. The internal combustion engine as recited in claim 10, and further comprising a series of magnets located on a side of said wheel opposite said cam-cutout and a corresponding series of magnets located on a wall of the rear housing facing said series of magnets, wherein said magnets act as a permanent magnet generator to produce electricity to power auxiliary equipment associated with said engine.

* * * * *